United States Patent [19]

Van Gorkum et al.

[11] Patent Number: 4,975,617

[45] Date of Patent: Dec. 4, 1990

[54] ELECTRIC DISCHARGE TUBE

[75] Inventors: Aart A. Van Gorkum; Leopold C. M. Beirens, both of Eindhoven, Netherlands; Bernhard Lersmacher, Aix-la-Chapelle, Fed. Rep. of Germany

[73] Assignee: U. S. Philips Corporation, New York, N.Y.

[21] Appl. No.: 910,816

[22] Filed: Sep. 23, 1986

Related U.S. Application Data

[63] Continuation of Ser. No. 569,870, Jan. 11, 1984, abandoned.

[30] Foreign Application Priority Data

Jan. 19, 1983 [NL] Netherlands ..... 8300191

[51] Int. Cl.[5] ..... H01J 1/46

[52] U.S. Cl. ..... 313/348; 313/349

[58] Field of Search ..... 313/348, 349, 304, 293, 313/296, 302, 343, 341

[56] References Cited

U.S. PATENT DOCUMENTS

| | | | |
|---|---|---|---|
| 3,307,063 | 2/1967 | Sarrois | 313/348 |
| 4,119,880 | 10/1978 | Wilcox et al. | 313/348 |
| 4,137,477 | 1/1979 | Krol et al. | 313/348 |
| 4,229,674 | 10/1980 | Hoet | 313/348 |
| 4,277,718 | 7/1981 | Shrader | 313/304 |
| 4,302,701 | 11/1981 | Beling | 313/348 |

*Primary Examiner*—Michael Razavi

*Attorney, Agent, or Firm*—Robert J. Kraus

[57] ABSTRACT

Flat and slightly convex pyrolytic graphite grid electrodes are very suitable for use in electric discharge tubes, are example in ion sources, cathode-ray tubes, travelling waveguides and transmitter tubes. It has proved possible to manufacture such electrodes by manufacturing the grid and the grid holder of the pyrolytic graphite electrode from one piece of pyrolytic graphite. Such integral grid electrodes have very good mechanical and thermal properties.

9 Claims, 2 Drawing Sheets

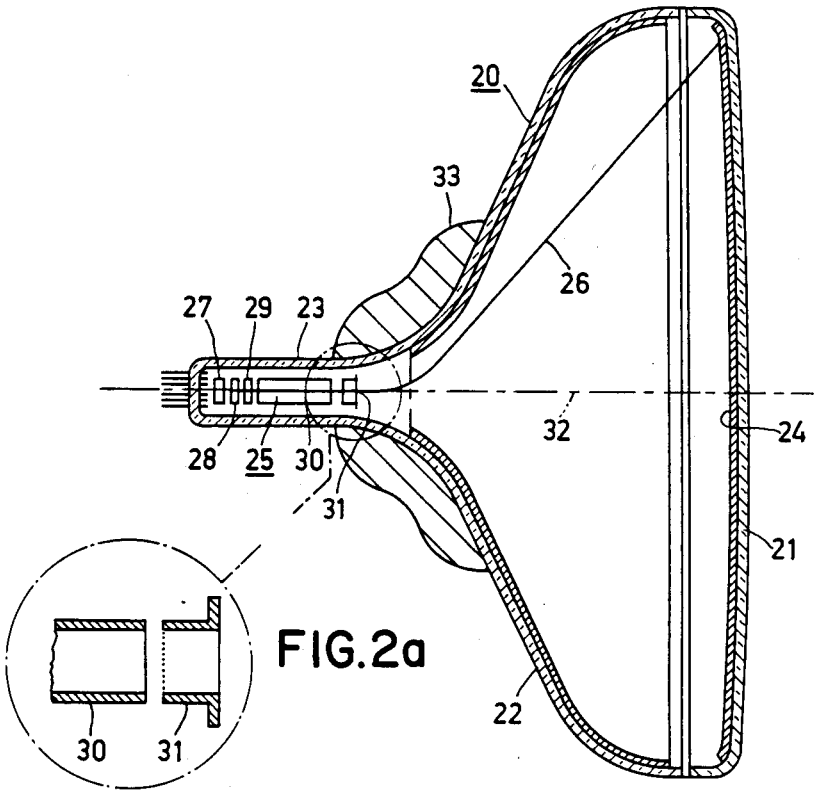
FIG.2a
FIG.2
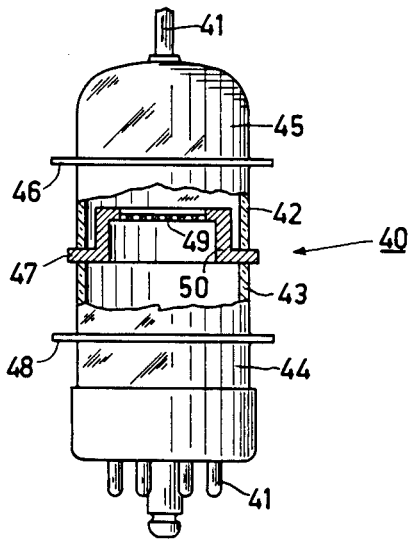
FIG.3

ELECTRIC DISCHARGE TUBE

This is a continuation of application Ser. No. 569,870, filed 11 January 1984 now abanded.

BACKGROUND OF THE INVENTION

The invention relates to an electric discharge tube comprising in an evacuated envelope a grid electrode having a substantially flat grid of pyrolytic graphite which is provided in a grid holder.

An electric discharge tube is a tube in which a beam or a flow of electrons and/or ions is generated, for example, an ion source, a cathode-ray tube, a travelling wavetube or a transmitter tube. Pyrolytic graphite is a synthetic form of carbon which is obtained on a suitable substrate or mandril by deposition of elementary carbon from a carbon-containing gaseous phase. By previously determining defined deposition parameters it is possible to manufacture layers of pyrolytic graphite which are distinguished by a pronounced anisotropy of a number of physical properties. A detailed description of the deposition process is found, for example, in "Carbon" 5 (1967), pp. 205–217 and in "Philips Technisch Tijdschrift" 28 (1967), pp. 133–144.

A method of manufacturing a grid electrode having a flat pyrolytic graphite grid is disclosed in U.S. Pat. No. 4,245,379. This patent describes how a flat pyrolytic graphite grid can be obtained by cutting a disc from a cylinder of pyrolytic graphite, then grinding it, providing it with apertures and stretching it in a grid holder. Such a method was necessary because previously it had proved impossible to manufacture directly thin flat pyrolytic graphite grids having a thickness of less than 100 μm by means of epitaxial growth on a hot mandril. This was impossible as a result of stresses which were generated in the grown layer during the cooling process. The method described in patent specification No. 4,245,379, however, has the disadvantage of being very laborious and the grid has to be stretched in a grid holder. Another disadvantage is that the heat transfer from the grid to the holder is not optimal so that at high thermal loads the possibility exists of the grid becoming too hot.

SUMMARY OF THE INVENTION

It is therefore an object of the invention to provide an electric discharge tube in which the grid need not be stretched in a grid holder and the heat transfer from the grid to the grid holder is optimal.

For that purpose, an electric discharge tube of the kind described in the opening paragraph is characterized according to the invention in that the grid holder also consists of pyrolytic graphite and is integral with the grid. It is indeed impossible to manufacture thin flat pyrolytic graphite grids having a thickness of approximately 100 μm by means of epitaxial growth on a hot mandril. It is possible, however, to manufacture a thick flat layer of pyrolytic graphite which does not warp upon cooling. It is also possible to manufacture a cup-shaped body of thick or thin (100–200 μm) pyrolytic graphite having a flat or slightly convex bottom. By using a disc of thick flat pyrolytic graphite and making the central portion thereof locally thinner by means of, for example, spark erosion or sand blasting, and then cutting a grid in the thinned part by means of, for example, a laser beam or an electron beam or by means of spark erosion or sand blasting, a grid electrode is obtained whose grid is integral with the grid holder. It is also possible to use a cup-shaped body of pyrolytic graphite. If the bottom of such a cup-shaped body is thick, a local thinning can be provided therein in the manner described, after which the grid apertures can be formed. It is also possible, however, to start with a cup-shaped body of thin pyrolytic graphite. A local thinning then is not necessary so that the grid apertures can be directly provided in the bottom. In such a cup-shaped grid electrode, the grid is kept stretched by the mechanically rigid cylinder wall. When a cup-shaped body of pyrolytic graphite having a slightly convex bottom is used as the starting material, it is also possible to manufacture slightly convex grids. If the cup-shaped electrode comprises a radially extending flange at its open end, this may serve for the assembly in the electric discharge tube.

A great advantage of manufacturing the grid and the grid holder as one assembly is that the heat transfer from the grid to the grid holder is optimal. This is because the thermal conductivity in the direction parallel to the surface of the pyrolytic graphite is large. The pyrolytic graphite cylinder of a cup-shaped electrode moreover also serves as a heat radiator.

BRIEF DESCRIPTION OF THE DRAWING

The invention will now be described in greater detail, by way of example, with reference to the drawing, in which:

FIG. 2 is a longitudinal sectional view of a cathode-ray tube having such an electrode, and FIG. 3 is an elevation, partly broken away, of a planar transmitter tube having such an electrode.

DESCRIPTION OF THE PREFERRED EMBODIMENTS

Figure 1A:
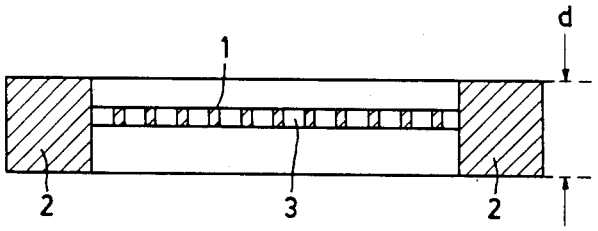
FIGS. 1*a*, 1*b* and 1*c* are longitudinal sectional views of a number of possible embodiments of grid electrodes according to the invention.
Figure 1B:
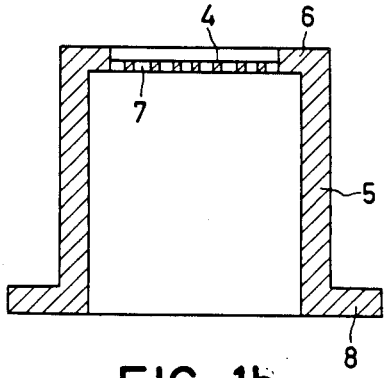
Figure 1C:
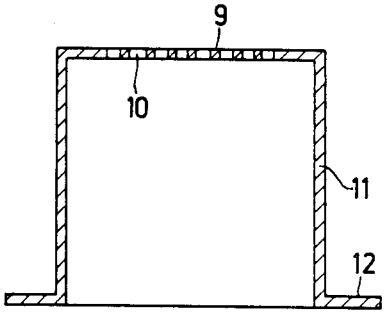

FIGS. 1*a* to 1*c* are longitudinal sectional views of a number of possible pyrolytic graphite grid electrodes for use in electric discharge tubes according to the invention. The grid electrode shown in FIG. 1*a* comprises a 100 μm thick pyrolytic graphite grid 1 which is integral with the annular grid holder 2. The grid holder 2 has a thickness d of 2 mm. The grid holder 2 and the pyrolytic graphite grid 1 are manufactured from a 2 mm thick disc of pyrolytic graphite which locally has been made thinner in the central part. The apertures 3 have then been provided in the thinner part by means of a laser beam. It has proved possible to provide 10 to 15 apertures per mm beside each other. The apertures in FIGS. 1*a*, *b* and *c* are shown diagrammatically only. Because the grid holder 2 and the grid 1 have been manufactured from one piece of pyrolytic graphite, the heat transfer from the grid (which, for example, is exposed to an electron bombardment), to the grid holder 2 is optimal.

The grid electrode of FIG. 1*b* is cup-shaped and comprises a 75 μm thick grid 4 of pyrolytic graphite which is provided in the bottom of the cup-shaped electrode. The grid holder in this case consists of the cylinder wall 5 and a part 6 of the bottom. The grid 4 has been obtained by locally thinning the bottom of a 1 mm thick cup-shaped body of pyrolytic graphite and then providing the apertures 7. The cup-shaped electrode has a radially extending flange 8 at its open end.

The grid electrode shown in FIG. 1*c* is also cup-shaped. This electrode, however, is manufactured from a thin cup-shaped pyrolytic graphite body (thickness 400 μm) in which the grid apertures 10 have been provided in the bottom. The grid 9 remains stretched because it is integral with the cylinder wall 11 which also has a radially extending flange 12.

Flange 8 of FIG. 1*b* and flange 12 of FIG. 1*c* may be used to secure the electrodes in a tube.

FIG. 2 is a longitudinal sectional view of a cathode-ray tube having an electrode as shown in FIG. 1. It comprises a glass envelope 20 which is composed of a display window 21, a cone 22 and a neck 23. A display screen 24 which comprises a thin phosphor layer is provided on the inside of the display window 21. An electron gun 25 for generating an electron beam 26 is disposed in the neck 23. The electron gun 25 comprises, centered around an axis 32, a cathode 27, a first electrode 28, a second electrode 29, a third electrode 30 and a fourth electrode 31. The electron beam 26 is deflected over the display screen 24 in two mutually perpendicular directions by means of a system 33 of deflection coils, and describes a frame on the display window.

In the non-prepublished Netherlands patent application no. 8200691 , corresponding to U.S. Pat. No. 4,567,399, it is explained that the spherical aberration of an electron beam can be reduced by placing a grid (gauze) in the accelerating/focusing lens of an electron gun. A pyrolytic graphite grid electrode as shown in FIG. 1*c* as the fourth gun electrode 31 is particularly suitable due to its good mechanical, thermal and electrical properties.

FIG. 3 is an elevation, partly broken away, of a transmitter tube having flat electrodes. This tube comprises an envelope 40 having connection pins 41. The envelope 40 is composed of two annular parts 42 and 43 and two cup-shaped parts 44 and 45. Electrodes 46, 47 and 48 are secured between these parts by means of a sealing connection. Electrode 47 is a control grid of pyrolytic graphite as shown in FIG. 1*b*. Because the grid 49 is integral with the grid holder 50, the thermal heat energy generated in the grid is very readily dissipated to the envelope.

What is claimed is:

1. An electric discharge tube including an envelope containing a grid electrode comprising a pyrolytic graphite grid supported in a grid holder, characterized in that the grid and the grid holder are integral parts of a single body of pyrolytic graphite material, said grid holder comprising a rigid annular support portion of the body which is relatively thick in a radial direction, and said grid comprising a relatively thin mesh formed to a predefined arbitrary shape by a perforated portion of the body stretching across a central opening in the annular support portion.

2. An electric discharge tube including an envelope containing a grid electrode comprising a pyrolytic graphite grid supported in a grid holder, characterized in that the grid and the grid holder are integral parts of a disc-shaped body of pyrolytic graphite material, said grid holder comprising a rigid annular support portion of the body which is relatively thick in a radial direction, and said grid comprising a relatively thin mesh formed to a predefined arbitrary shape by a perforated portion of the body stretching across a central opening in the annular support portion.

3. An electric discharge tube including an envelope containing a grid electrode comprising a pyrolytic graphite grid supported in a grid holder, characterized in that the grid and the grid holder are integral parts of a cup-shaped body of pyrolytic graphite material, said grid holder comprising a rigid annular support portion of the body which is relatively thick in a radial direction, and said grid comprising a relatively thin mesh formed to a predefined arbitrary shape by a perforated portion of the body stretching across a central opening in the annular support portion.

4. An electric discharge tube as in claim 1, 2 or 3 where the mesh is substantially flat.

5. An electric discharge tube as in claim 1, 2 or 3 where the mesh has a convex curvature.

6. An electric discharge tube as in claim 3 where the cup-shaped body includes a sidewall having a flange extending radially therefrom.

7. An electric discharge tube as in claim 1, 2 or 3 where the thickness of the annular support portion in a direction transverse to the radial direction is larger than the thickness of the mesh in said transverse direction.

8. An electric discharge tube as in claim 1, 2 or 3 where the mesh has a thickness no larger than approximately 100 micrometers.

9. An electric discharge tube as in claim 7 where the thickness of the annular support portion in the direction transverse to the radial direction is at least several times as large as the thickness of the mesh in said transverse direction.

* * * * *